United States Patent [19]

Burger et al.

[11] Patent Number: 4,522,124

[45] Date of Patent: Jun. 11, 1985

[54] INKING ROLLER FOR THE INKING EQUIPMENT OF A ROTARY PRESS

[75] Inventors: Rainer Burger, Augsburg; Gerhard Bittl, Mering; Ingo Kobler, Anhausen, all of Fed. Rep. of Germany

[73] Assignee: M.A.N.-ROLAND Druckmaschinen Aktiengesellschaft, Offenbach am Main, Fed. Rep. of Germany

[21] Appl. No.: 521,652

[22] Filed: Aug. 10, 1983

[30] Foreign Application Priority Data

Aug. 13, 1982 [DE] Fed. Rep. of Germany ..... 3230119

[51] Int. Cl.[3] ..... B41F 31/26

[52] U.S. Cl. ..... 101/350; 101/425; 118/261; 118/DIG. 15

[58] Field of Search ..... 101/350, 363, 425, 364, 101/365, 207, 208, 210, 157, 169, 348; 118/DIG. 15, 261; 29/121.1, 127, 121 R

[56] References Cited

U.S. PATENT DOCUMENTS 3,690,254 9/1972 Krochert ..... 101/350
4,211,167 7/1980 Corse ..... 101/350 X

FOREIGN PATENT DOCUMENTS 1918987 6/1971 Fed. Rep. of Germany .

*Primary Examiner*—Paul T. Sewell
*Assistant Examiner*—Moshe I. Cohen
*Attorney, Agent, or Firm*—Frishauf, Holtz, Goodman & Woodward

[57] ABSTRACT

In order to eliminate the contaminant particles collecting between the inking roller in the inking system of a rotary printing machine and the doctor blade, a strip or wiper element of elastic material extending in the axial direction and projecting from the surface of the inking roller is glued onto the surface of the ink roller or inserted into grooves thereon to pick up and transport small contaminants from the trough into the ink path where they are harmless.

10 Claims, 3 Drawing Figures

INKING ROLLER FOR THE INKING EQUIPMENT OF A ROTARY PRESS

The present invention relates to an inking system of a rotary printing machine and more particularly to an inking roller having a circular-cylindrical surface against which a doctor blade for metering the ink can be adjustably placed and from which ink is transferred to a further inking roller adjustably placed against the first roller, and having a device for removing contaminant particles found in the ink supply.

BACKGROUND AND PRIOR ART

An inking roller of the above type is known from German Examined Patent Application DE-AS No. 1 918 987, to which U.S. Pat. No. 3,690,254, KROCHERT, corresponds. In order to remove the contaminant particles found in the ink supply and deposited on the surface of the inking roller, a groove is provided in this known inking roller which extends in the axial direction and takes a spiral course and into which the doctor blade is supposed to scrape the contaminant particles. The interfering particles cannot be removed sufficiently well with this groove, however, because due to the gap conventionally located between the doctor blade and the surface of the inking roller, the particles cannot be scraped completely from the surface of the inking roller and deposited into the groove.

A need thus exists for an ink roller so constructed that, despite the required gap between the ink roller surface and the doctor blade, it is possible to remove the contaminant particles collecting in the vicinity of the gap.

THE INVENTION

It is an object to provide for an inking system for a rotary printing machine in which contaminant particles are effectively removed from the ink trough and transferred to an inking roller of the printing machine.

Briefly, the ink roller which, preferably, is in ink transfer contact with an ink film roller is formed with a strip of elastic material projecting from the surface of the ink roller. This strip extends axially over the length of the ink roller and projects from the surface thereof by a distance which corresponds at least approximately to the width of the gap between the ink roller and a doctor blade which meters the amount of ink being transferred from an ink trough to the ink roller.

The strip may extend parallel to the axis of the ink roller or may be spiralled thereabout. It can be an elastic, or plastic material set into a groove, or otherwise adhered to the surface of the ink roller so as to project therefrom by approximately the gap distance.

DRAWINGS

Figure 1:
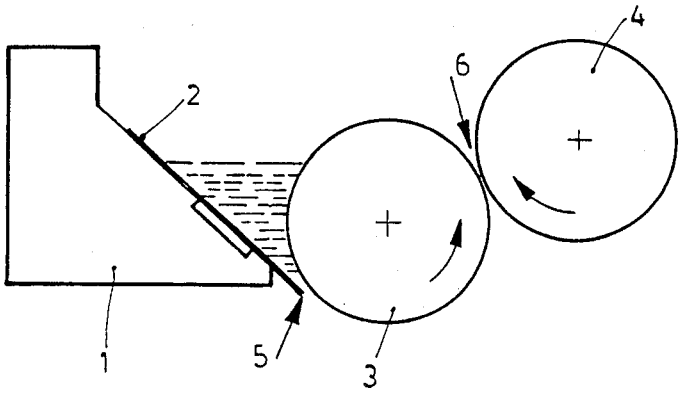
Figure 2:
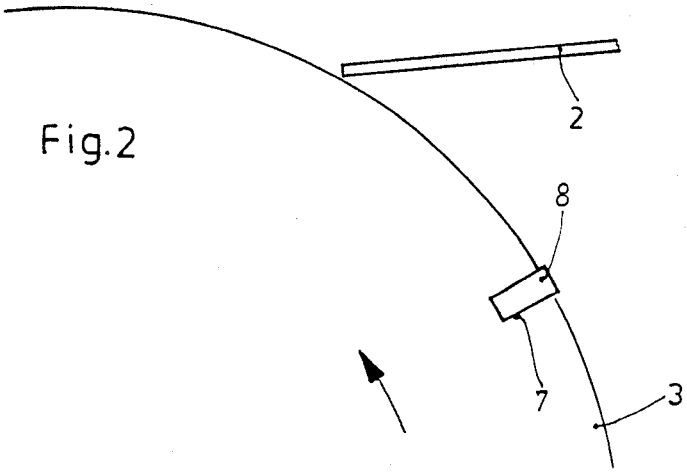
Figure 3:
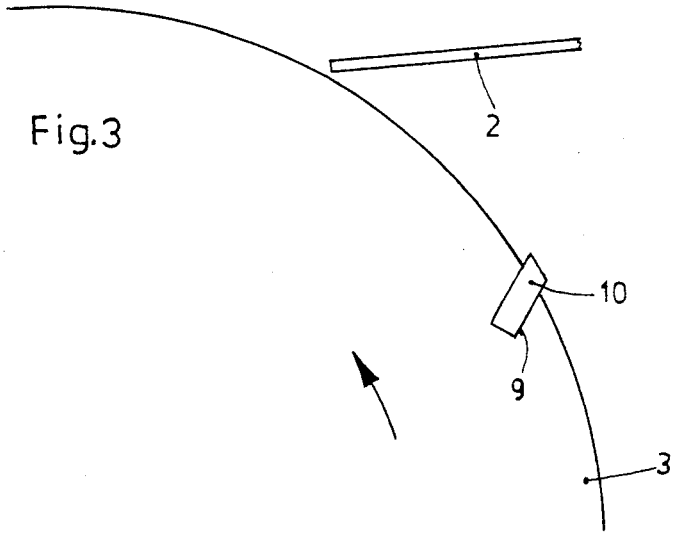

FIG. 1 schematically shows the ink trough section of a film-type inking system for a rotary printing machine;

FIG. 2 is a simplified partial view of the inking roller embodied in accordance with the invention; and FIG. 3 is a simplified partial view of a further form of embodiment of the inking roller according to the invention.

The ink trough 1 shown in FIG. 1 has a doctor blade 2. An ink roller 3 is positioned against the ink trough 1, representing the front boundary of the ink trough, which is filled with printing ink. Ink is transferred from the ink roller 3 onto the next ink roller 4, which if the inking system is conceived as a film inking system is known as an ink film roller.

FIG. 1 shows that there is a gap 5 between the lower edge of the doctor blade 2 and the ink roller 3. Its width depends on the desired thickness of the ink film to be transferred using the ink roller 3. Since in the known manner the ink roller 3 is driven at a substantially lower speed than is the next ink film roller 4, it is also necessary to maintain a distance, namely a gap 6, between the ink roller 3 and the ink film roller 4. Usually the width of the gap 6 between the ink roller 3 and the ink film roller 4 is smaller than that of the gap 5 between the doctor blade 2 and the ink roller 3. It is accordingly assured that the film of ink on the ink roller 3 is generated at an appropriate thickness and thus because of ink splitting, it is possible to effect a partial transfer onto the following ink film roller 4. The arrows, not identified by numerals, on the rollers 3, 4 indicate the direction of rotation thereof.

The uniformity of the layer of ink to be generated in accordance with the distance between the inking roller 3 and the doctor blade 2 is impaired by contaminant particles deposited in the vicinity of the gap 5 between the ink roller 3 and the doctor blade 2.

To eliminate the above problem, the invention proposes the provision of elevations on the surface of the ink roller 3, which rid the region of the gap 5 between the ink roller 3 and the blade 2 of the undesirable contaminant particles, that is, which remove them from the ink supply of the ink trough. As shown in FIG. 2 (drawn upside down with respect to FIG. 1 for better illustration), a projecting strip 8, of elastic material, is fitted in a groove 7 extending in the axial direction and milled into the surface of the ink roller 3. This groove 7 may be straight or spiralled.

According to the invention, the wiping element or strip 8, preferably of some elastic material, is inserted into the groove 7, for instance being glued in place. Suitable materials for the strip 8 are hard rubber and plastic. The strip 8 in the groove 7 projects slightly beyond the circular-cylindrical surface of the ink roller 3. The extent of this elevation should be approximately equal to the width of the gap 5. If it is somewhat greater, then the relatively soft strip 8 will be worn down by the relatively hard edge of the doctor blade 2 during operation, that is, during the rotation of the ink roller 3, so that an automatic adaptation of the portion of the strip 8 protruding from the surface of the ink roller 3 to the width of the gap 5 will be established. Further wear of the strip 8 takes place in the gap 6 between the ink roller 3 and the film roller 4, since as already mentioned this gap 6 is smaller than the gap 5. However, it is also possible to the extent to which the strip 8 protrudes to be fixed beforehand such that it is slightly smaller than the width of the gap 6, so that the above-described events will not occur. The strip 8 preferably has a width of approximately 3 mm and is seated in a groove 7 having a depth of 4 mm.

As a result of the use of the strip 8, the contaminant particles collecting in the region between the surface of the ink roller 3 and the positioning area of the doctor blade 2 are drawn out of the ink trough and carried along the further course of the ink, where they no longer have a disruptive effect.

FIG. 3 shows a different cross-sectional form of a strip 10, which is inserted in a groove 9 on the surface of the ink roller 3. This strip 10 has a wedge-shaped cross-section in the area where it projects from the surface of the ink roller 3.

In the exemplary embodiments of FIGS. 2 and 3, only one strip 8 or 10 each is shown. If the desired cleaning action is not attained with one strip in the ink roller 3, then two or more such strips can also be provided on the circumference of the ink roller 3. Inserting the strips 8, 10 in grooves 7, 9 extending in the axial direction and having a helical course affords a sufficiently firm fixation and positioning of the strips 8, 10. It is also possible, however, without using grooves in the ink rollers, to attach the strips, with the desired thickness, directly to the surface of the ink roller 3, for instance gluing them on with a suitable adhesive.

We claim:

1. Inking system for a rotary printing machine having
an ink trough (1);
an ink roller (3) having a cylindrical surface;
a doctor blade (2) to control the amount of ink being picked up by the ink roller from the ink trough and positionable with respect to the roller to leave a small gap (5) between the edge of the doctor blade and the surface of the roller;
an ink transfer roller (4) located to receive ink from the ink roller (3);
and means for inhibiting collection of contaminating particles in the ink trough (1),
said means comprising,
an elastic strip (8, 10) projecting from the cylindrical surface of the ink roller (3) and extending axially over the length of the roller, said strip (8, 10) projecting from the surface of the ink roller (3) by a distance of approximately the width of the gap, said elastic strip comprising a material which is soft with respect to the material forming the edge of the doctor blade, and which is elastically deformable to permit passage through a nip (6) formed between the ink roller (3) and the ink transfer roller (4).

2. System according to claim 1 wherein the strip (8, 10) extends spirally about the surface of the ink roller (3).

3. System according to claim 1 wherein said strip has approximately rectangular cross-section.

4. System according to claim 1 wherein the cross-section of the portion of the strip (10) projecting from the surface of the ink roller (3) is wedge-shaped.

5. System according to claim 1 wherein said elastic strip (8, 10) comprises at least one of the materials of the group consisting of: hard rubber and plastic.

6. System according to claim 1 wherein said strip is attached to the ink roller by an adhesive.

7. System according to claim 1 wherein the ink roller (3) is formed with a groove (7, 9) and said strip (8, 10) is secured in said groove.

8. System according to claim 7 wherein the strip (8, 10) extends spirally about the surface of the ink roller (3).

9. System according to claim 1 wherein said ink transfer roller (4) comprises an ink film roller.

10. System according to claim 9 wherein said ink roller (3) is driven at a first circumferential speed;
and said film ink transfer roller (4) is driven at the speed which is high with respect to said first speed.

* * * * *